US007435058B2

(12) United States Patent
Campbell et al.

(10) Patent No.: US 7,435,058 B2
(45) Date of Patent: Oct. 14, 2008

(54) CERAMIC MATRIX COMPOSITE VANE WITH CHORDWISE STIFFENER

(75) Inventors: Christian X. Campbell, Orlando, FL (US); Harry A. Albrecht, Hobe Sound, FL (US); Yevgeniy Shteyman, West Palm Beach, FL (US); Jay A. Morrison, Oviedo, FL (US)

(73) Assignee: Siemens Power Generation, Inc., Orlando, FL (US)

( * ) Notice: Subject to any disclaimer, the term of this patent is extended or adjusted under 35 U.S.C. 154(b) by 396 days.

(21) Appl. No.: 11/036,990

(22) Filed: Jan. 18, 2005

(65) Prior Publication Data

US 2008/0181766 A1 Jul. 31, 2008

(51) Int. Cl.
*F01D 5/18* (2006.01)

(52) U.S. Cl. ..... 416/236 R; 416/232; 416/241 R

(58) Field of Classification Search ..... 416/241 B, 416/236 R, 232, 233, 235
See application file for complete search history.

(56) References Cited

U.S. PATENT DOCUMENTS

| | | | |
|---|---|---|---|
| 3,910,716 | A | 10/1975 | Roughgarden et al. |
| 4,396,349 | A | 8/1983 | Hueber |
| 4,519,745 | A | 5/1985 | Rosman et al. |
| 4,530,884 | A | 7/1985 | Erickson et al. |
| 4,563,125 | A | 1/1986 | Boudigues et al. |
| 4,563,128 | A | 1/1986 | Rossmann |
| 4,629,397 | A | 12/1986 | Schweitzer |
| 4,639,189 | A | 1/1987 | Rosman |
| 4,643,636 | A | 2/1987 | Libertini et al. |
| 4,645,421 | A | 2/1987 | Huether |
| 4,650,399 | A | 3/1987 | Craig et al. |
| 4,768,924 | A | 9/1988 | Carrier et al. |
| 4,790,721 | A | 12/1988 | Morris et al. |
| 4,838,031 | A | 6/1989 | Cramer |
| 4,907,946 | A | 3/1990 | Ciokajlo et al. |
| 5,027,604 | A | 7/1991 | Krueger |
| 5,226,789 | A | 7/1993 | Donges |
| 5,306,554 | A | 4/1994 | Harrison et al. |
| 5,314,309 | A | 5/1994 | Blakeley et al. |
| 5,328,331 | A | 7/1994 | Bunker et al. |
| 5,358,379 | A | 10/1994 | Pepperman et al. |
| 5,375,978 | A | 12/1994 | Evans et al. |
| 5,382,453 | A | 1/1995 | Mason |
| 5,484,258 | A | 1/1996 | Isburgh et al. |
| 5,493,855 | A | 2/1996 | Walters et al. |
| 5,494,402 | A | 2/1996 | Glezer et al. |
| 5,584,652 | A | 12/1996 | Shaffer et al. |
| 5,605,046 | A | 2/1997 | Liang |
| 5,616,001 | A | 4/1997 | Boyd |

(Continued)

FOREIGN PATENT DOCUMENTS

| | | |
|---|---|---|
| EP | 1 126 135 A2 | 8/2001 |

(Continued)

*Primary Examiner*—Edward Look
*Assistant Examiner*—Dwayne J White

(57) ABSTRACT

A means (22) for structurally stiffening or reinforcing a ceramic matrix composite (CMC) gas turbine component, such as an airfoil-shaped component, is provided. This structural stiffening or reinforcing of the airfoil allows for reducing bending stress that may be produced from internal or external pressurization of the airfoil without incurring any substantial thermal stress. The stiffener is disposed on a CMC wall and generally extends along a chord length of the airfoil.

18 Claims, 3 Drawing Sheets

U.S. PATENT DOCUMENTS

| | | | | |
|---|---|---|---|---|
| 5,630,700 | A | 5/1997 | Olsen et al. | |
| 5,640,767 | A | 6/1997 | Jackson et al. | |
| 5,720,597 | A | 2/1998 | Wang et al. | |
| 5,791,879 | A | 8/1998 | Fitzgerald et al. | |
| 5,820,337 | A | 10/1998 | Jackson et al. | |
| 6,000,906 | A | 12/1999 | Draskovich | |
| 6,164,903 | A | 12/2000 | Kouris | |
| 6,197,424 | B1 | 3/2001 | Morrison et al. | |
| 6,200,092 | B1 | 3/2001 | Koschier | |
| 6,241,469 | B1 | 6/2001 | Beeck et al. | |
| 6,325,593 | B1 | 12/2001 | Darkins, Jr. et al. | |
| 6,368,663 | B1 | 4/2002 | Nakamura et al. | |
| 6,398,501 | B1 | 6/2002 | Darkins, Jr. et al. | |
| 6,451,416 | B1 | 9/2002 | Holowczak et al. | |
| 6,514,046 | B1 | 2/2003 | Morrison et al. | |
| 6,709,230 | B2 * | 3/2004 | Morrison et al. | 415/115 |
| 7,128,532 | B2 * | 10/2006 | Petervary et al. | 416/97 A |
| 2002/0164250 | A1 | 11/2002 | Chung et al. | |

FOREIGN PATENT DOCUMENTS

| | | | |
|---|---|---|---|
| EP | 1 316 772 | A1 | 6/2003 |
| EP | 1 321 712 | A1 | 6/2003 |
| EP | 1 367 223 | A2 | 12/2003 |
| GB | 2 027 496 | A | 2/1980 |
| GB | 2272731 | A * | 5/1994 |

* cited by examiner

CERAMIC MATRIX COMPOSITE VANE WITH CHORDWISE STIFFENER

FIELD OF THE INVENTION

The present invention is generally related to the field of gas turbine engines, and, more particularly, to a ceramic matrix composite vane having a chord-wise stiffener.

BACKGROUND OF THE INVENTION

Gas turbine engines are known to include a compressor section for supplying a flow of compressed combustion air, a combustor section for burning a fuel in the compressed combustion air, and a turbine section for extracting thermal energy from the combustion air and converting that energy into mechanical energy in the form of a shaft rotation. Many parts of the combustor section and turbine section are exposed directly to the hot combustion gasses, for example, the combustor, the transition duct between the combustor and the turbine section, and the turbine stationary vanes, rotating blades and surrounding ring segments.

It is also known that increasing the firing temperature of the combustion gas may increase the power and efficiency of a combustion turbine. Modern, high efficiency combustion turbines have firing temperatures in excess of 1,600° C., which is well in excess of the safe operating temperature of the metallic structural materials used to fabricate the hot gas flow path components. Accordingly, insulation materials such as ceramic thermal barrier coatings (TBCs) have been developed for protecting temperature-limited components. While TBCs are generally effective in affording protection for the present generation of combustion turbine machines, they may be limited in their ability to protect underlying metal components as the required firing temperatures for next-generation turbines continue to rise.

Ceramic matrix composite (CMC) materials offer the capability for higher operating temperatures than do metal alloy materials due to the inherent nature of ceramic materials. This capability may be translated into a reduced cooling requirement that, in turn, may result in higher power, greater efficiency, and/or reduced emissions from the machine. However, the required cross-section for some applications may not appropriately accommodate the various operational loads that may be encountered in such applications, such as the thermal, mechanical, and pressure loads. For example, due to the low coefficient of thermal conductivity of CMC materials and the relatively thick cross-section necessary for many applications, backside closed-loop cooling may be somewhat ineffective as a cooling technique for protecting these materials in combustion turbine applications. In addition, such cooling techniques, if applied to thick-walled, low conductivity structures, could result in unacceptably high thermal gradients and consequent stresses.

It is well known that CMC airfoils are subject to bending loads due to external aerodynamic forces. Techniques for increasing resistance to such bending forces have been described in patents, such as U.S. Pat. No. 6,514,046, and may be particularly useful for airfoils having a relatively high aspect ratio (e.g., radial length to width). However, such techniques may not provide resistance to internally applied pressures.

High temperature insulation for ceramic matrix composites has been described in U.S. Pat. No. 6,197,424, which issued on Mar. 6, 2001, and is commonly assigned with the present invention. That patent describes an oxide-based insulation system for a ceramic matrix composite substrate that is dimensionally and chemically stable at a temperature of approximately 1600° C. That patent exemplarily describes a stationary vane for a gas turbine engine formed from such an insulated CMC material. A similar gas turbine vane 10 is illustrated in FIG. 1 as including an inner wall 12. Backside cooling of the inner wall 12 may be achieved by convection cooling, e.g. via direct impingement through supply baffles (not shown) situated in relatively large interior chambers 18 using air directed from the compressor section of the engine.

If baffles or other means are used to direct a flow of cooling fluid throughout the airfoil member for backside cooling and/or film cooling, the cooling fluid is typically maintained at a pressure that is in excess of the pressure of the combustion gasses on the outside of the airfoil so that any failure of the pressure boundary will not result in the leakage of the hot combustion gas into the vane. Also, as stated above, the interior chambers 18 may be used with appropriate baffling to create impingement of the cooling fluid onto the backside of the surface to be cooled. Thus, such interior chambers enable an internal pressure force that can result in the undesirable ballooning of the airfoil structure due to the internal pressure of the cooling fluid applied to the relatively large surface area of the interior chambers 18. For example, CMC vanes with hollow cores may be susceptible to bending loads associated with such internal pressures due to their anisotropic strength behavior.

For a solid core CMC airfoil, the resistance to internal pressure depends to a large extent on establishing and maintaining a reliable bond joint between the CMC and the core material. In practice, this may be somewhat difficult to achieve with smooth surfaces and manufacturing constraints imposed by the co-processing of these materials.

For laminate airfoil constructions, the through-thickness direction has strength of approximately 5% of the strength for the in plane or fiber-direction. Stresses along the relatively weaker direction should be avoided. It is known that the internal pressure causes high interlaminar tensile stresses in a hollow airfoil, especially concentrated in the trailing edge (TE) inner radius region, but also present in the leading edge (LE) region.

This issue is accentuated in large airfoils having a relatively long chord length, such as those used in large land-based gas turbines. The longer internal chamber size results in increased bending moments and stresses for a given internal pressure differential.

One known technique for dealing with these stresses is the construction of internal spars 14 disposed between the lower and upper surfaces of the inner wall 12. The internal spars may extend, either continuously or in segmented fashion, from one side of the airfoil to an opposite side of the airfoil. However, construction of such spars for CMC vanes involves some drawbacks, such as due to manufacturing constraints, and thermal stress that develops due to differential thermal growth at the hot airfoil skin and the relatively cold spars 14, as well as thermal gradient present at the root of the spar. The resulting thermal stress may cause cracks to develop at the intersection of the spars and the inner wall leading to failure of the turbine foil.

Therefore, improvements for reducing bending stresses resulting from internal pressurization of an airfoil are desirable.

BRIEF DESCRIPTION OF THE DRAWINGS

These and other advantages of the invention will be more apparent from the following description in view of the drawings that show.

DETAILED DESCRIPTION OF THE INVENTION

Figure 1:
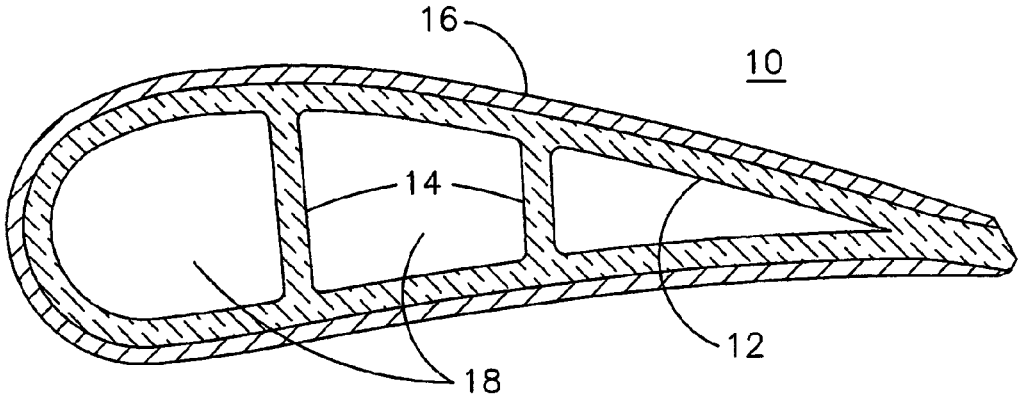
FIG. 1 PRIOR ART
FIG. 1 is a cross-sectional view of a prior art gas turbine vane made from a ceramic matrix composite material covered with a layer of ceramic thermal insulation.
Figure 2:
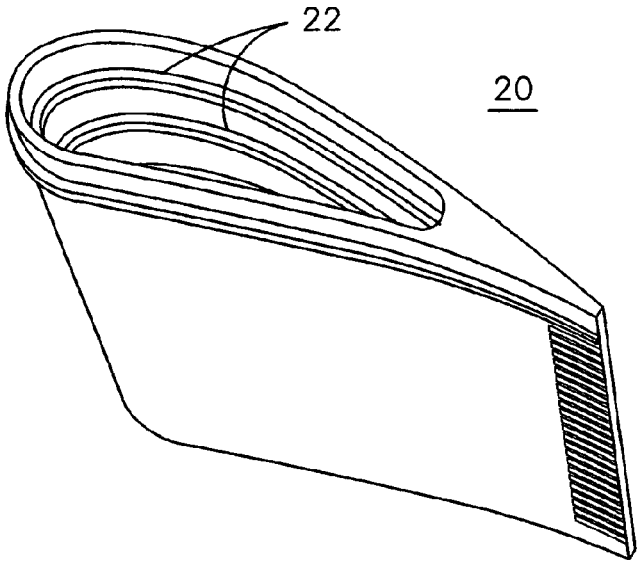
FIG. 2 is an isometric view of an exemplary ceramic matrix composite gas turbine vane including a chord-wise stiffener arrangement embodying aspects of the present invention.

FIG. 2 is an isometric view of an exemplary ceramic matrix composite gas turbine vane 20 embodying aspects of the present invention. The term ceramic matrix composite is used herein to include any fiber-reinforced ceramic matrix material as may be known or may be developed in the art of structural ceramic materials. The fibers and the matrix material surrounding the fibers may be oxide ceramics or non-oxide ceramics or any combination thereof. A wide range of ceramic matrix composites (CMCs) have been developed that combine a matrix material with a reinforcing phase of a different composition (such as mulite/silica) or of the same composition (alumina/alumina or silicon carbide/silicon carbide). The fibers may be continuous or long discontinuous fibers. The matrix may further contain whiskers, platelets or particulates. Reinforcing fibers may be disposed in the matrix material in layers, with the plies of adjacent layers being directionally oriented to achieve a desired mechanical strength.

The inventors of the present invention have recognized an innovative means for structurally stiffening or reinforcing a CMC airfoil without incurring any substantial thermal stress. By way of example, this structural stiffening or reinforcing of the airfoil allows reducing bending stress that may be produced from internal or external pressurization of the airfoil. The techniques of the present invention may be applied to a variety of airfoil configurations, such as an airfoil with or without a solid core, or an airfoil with or without an external thermally insulating coating. For readers desirous of obtaining background information in connection with an exemplary solid-core ceramic matrix composite gas turbine vane, reference is made to U.S. Pat. No. 6,709,230, assigned in common to the assignee of the present invention and incorporated herein by reference in its entirety.

In one exemplary embodiment, the stiffening or reinforcing means 22 generally extends along a chord-wise direction of the airfoil. That is, the stiffening or reinforcing structure, such as one or more projecting members or ribs, extends generally parallel to the chord length of the airfoil in lieu of extending transverse to the chord length, as in the case of spars. As used herein the expression generally extending in a chord-wise direction encompasses stiffening or reinforcing means that may extend not just parallel to the chord length but stiffening or reinforcing means that may extend within a predefined angular range relative to the chord length. In one exemplary embodiment, the angular range relative to the chord length may comprise approximately +/−45 degrees. In another exemplary embodiment, the angular range relative to the chord length may comprise approximately +/−15 degrees. It will be appreciated that the selection of stiffener angle may be tailored to the specific needs of a given application. For example, stiffening for internal pressure may call for a relatively lower stiffener angle whereas stiffening for external pressure may call for a relatively higher stiffener angle. Furthermore, selection of stiffener angle is not limited to a balanced or symmetrical (+/−) angular range, nor is it limited to be uniformly constructed throughout the entire airfoil. For example, at a leading and/or trailing edge, which are generally most susceptible to internal pressure stresses, a relatively lower stiffener angle may be used compare to the stiffener angle used elsewhere, such as at a pressure or suction side panel, which are generally more susceptible to external pressure bending loads. In one exemplary embodiment, one or more members that make up the chord-wise stiffening or reinforcing structure may circumscribe the periphery of the inner wall of the airfoil.

Chord-wise stiffening for the airfoil, as may be provided by one or more chord-wise ribs, is desirable over a CMC airfoil having relatively thicker walls for withstanding the bending stresses that may result from internal or external pressurization of the airfoil. For example, a CMC airfoil with thick walls may entail generally complex arrangements for defining suitable internal cooling passages. One exemplary advantage provided by a chord-wise stiffener is that bending stiffness can be substantially increased while keeping the majority of the airfoil wall relatively thin and thus easier to cool. Cooling arrangements could involve convective or impingement cooling of the thin sections in between individual stiffener members.

Figure 3:
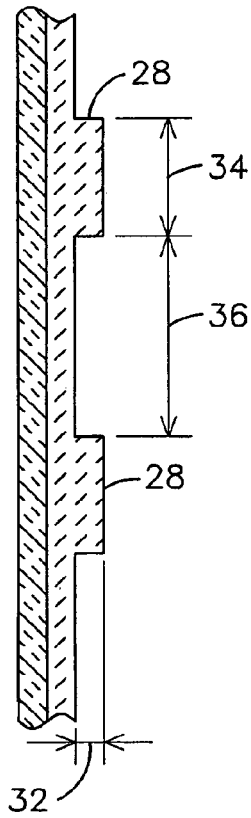
FIG. 3 is a cross-sectional view of the exemplary arrangement for the chord-wise stiffener shown in FIG. 2.

FIG. 3 is a cross-sectional of the exemplary arrangement of the chord-wise stiffener shown in FIG. 2. It will be appreciated that the concepts of the present invention are not limited to any specific structural arrangement for the chord-wise stiffener since the actual geometry for any given chord-wise stiffener may vary based on the specific application. However, some exemplary guidelines are described below.

The physical characteristics for the individual chord-wise stiffener members (that in combination make up a chord-wise stiffener arrangement for the airfoil) may be adapted or optimized for a given application. Examples of such physical characteristics may be shape (e.g., square, trapezoidal, sinusoidal, etc.), height, width, and spacing between individual chord-wise stiffener members. For example, the height 32 of a chord-wise stiffener member 28 relative to the thickness of the surrounding material may be chosen based on the specific needs of a given application. For example, the pressure load requirements (e.g., a relatively thicker stiffener may better handle an increased pressure load) may require balancing relative to the thermal load requirements (e.g., a relatively thinner stiffener may better handle an increased thermal load). Also the width 34 of the stiffener member relative to the separation distance 36 between adjacent stiffener members may be tailored to appropriately meet the needs of the application.

Figure 4:
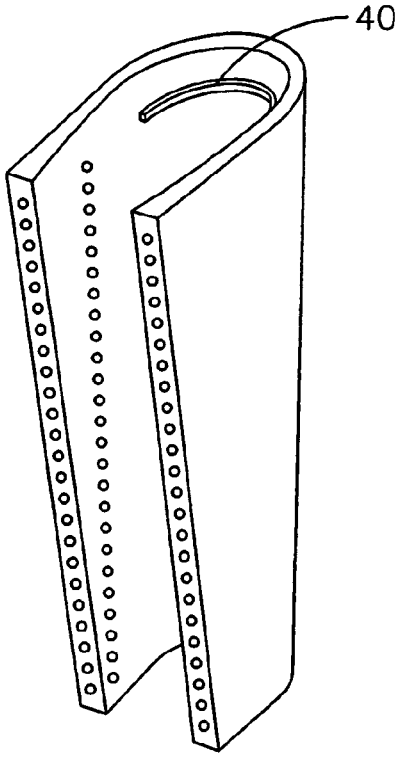
FIG. 4 illustrates a chord-wise stiffener member disposed just over one exemplary region of interest of an airfoil, such as the leading edge region of the airfoil.
Figure 5:
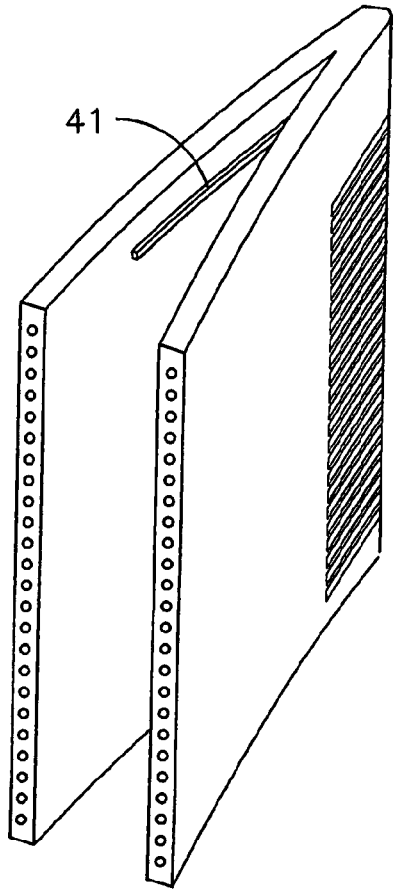
FIG. 5 illustrates a chord-wise stiffener member disposed just over another exemplary region of interest of an airfoil, such as the trailing edge region of the airfoil.

In one exemplary embodiment, one or more chord-wise stiffener members may be optionally provided just over a region of interest of the airfoil, such as the LE and/or TE regions of the airfoil, as opposed to providing a chord-wise stiffener over the entire airfoil periphery. For example, FIG. 4 illustrates an exemplary chord-wise stiffener member 40 just over the leading edge region of the airfoil and FIG. 5 illustrates a chord-wise stiffener member 41 just over the trailing edge region of the airfoil. It will be understood that respective chord-wise stiffener members may be provided in combination for both the trailing and leading edge regions.

Figure 6:
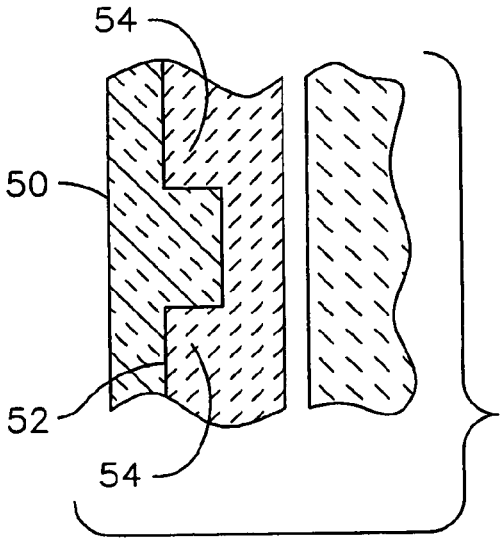
FIG. 6 is a cross-sectional view of an exemplary hybrid CMC structure where a thermal insulating layer may be disposed over an external surface of the CMC airfoil where a chord-wise stiffener is disposed.

In one exemplary embodiment, one or more chord-wise stiffener members may be located on the external surface of the inner CMC wall. This may be particularly suited for a hybrid CMC structure such as shown in FIG. 6 where a thermal insulating layer 50 is disposed over an outer surface 52 of the CMC airfoil. See U.S. Pat. No. 6,197,424 for an example of high temperature insulation for ceramic matrix composites. As shown in FIG. 6, the insulating layer 50 may be disposed to encapsulate one or more external stiffener members 54 and provide a smooth aerodynamic surface.

In another aspect of the present invention, as compared to the bonding strength that may be achieved between smooth surfaces, stiffener members 54 can improve the bonding strength between the insulating layer 50 and the outer CMC surface 52 at least due to the following exemplary mechanisms:

1. increased surface area for the bond joint;
2. shear component added to interlaminar tensile loads; and
3. interlocking between the chord-wise ribs and the insulating layer enables a mechanical joint.

Figure 7:
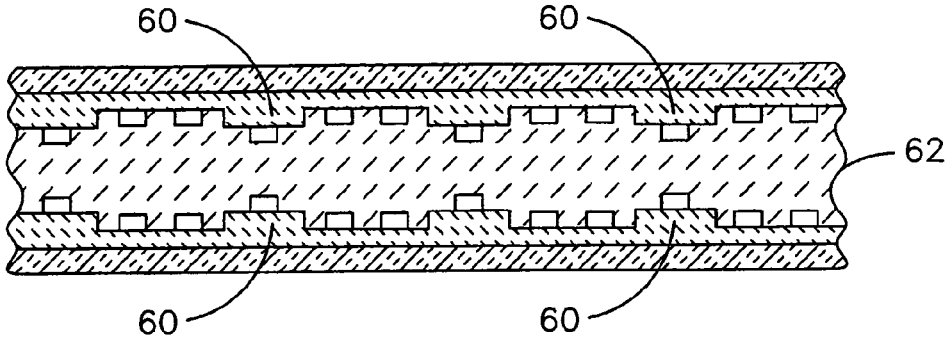
FIG. 7 is a cross-sectional view of a solid-core ceramic matrix composite gas turbine vane embodying aspects of the present invention.

As stated above and illustrated in FIG. 7, a chord-wise stiffener 60 can be used in combination with a solid core 62. In this embodiment, the chord-wise stiffening structure in addition to providing increased bending stiffness, also provides some aspects applicable to an airfoil having a solid core, such as providing superior airfoil integrity. Exemplary mechanisms for enhancing overall airfoil integrity may be as follows: 1) increased stiffness of the CMC airfoil to reduce bending stresses due to internal pressure—e.g., in case the core becomes disbonded; 2) superior structural integrity for the core bonding (such as via the mechanisms discussed above for an external stiffener arrangement). In this case, the entire core may be viewed as a geometric solid that forms a securely bonded internal reinforcer configured to keep the CMC walls from separating, thus essentially eliminating effects due to the bending stresses that may develop in the airfoil.

Figure 8:
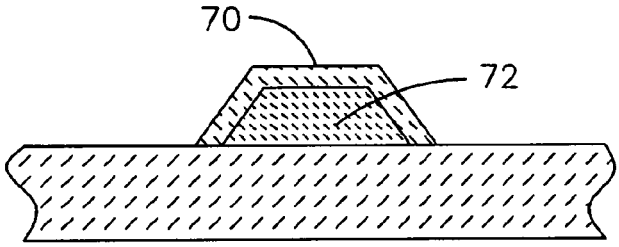
FIGS. 8-10 illustrate exemplary techniques for constructing a chord-wise stiffener on a ceramic matrix composite gas turbine vane.

It will be appreciated by those skilled in the art that the construction of a chord-wise stiffener may take various forms. For example, as illustrated in FIG. 8, a chord-wise stiffener 70 may comprise a cavity 72 filled with a suitable material, such as a ceramic material, air or cooling fluid.

Figure 9:
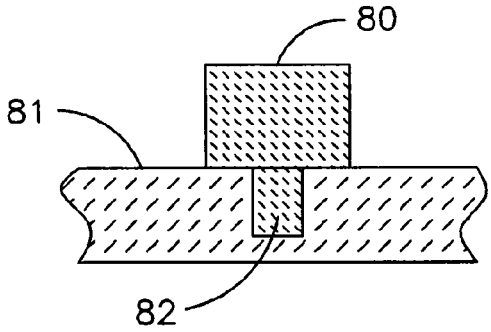
Figure 10:
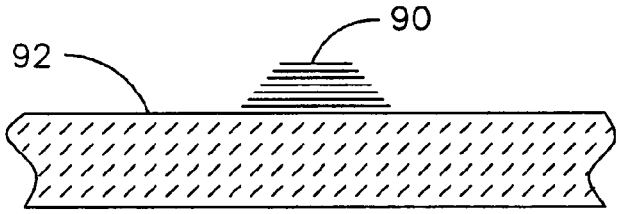

As illustrated in FIG. 9, a chord-wise stiffener 80 may comprise a separate structure relative to the CMC wall, as opposed to a stiffener structure integrally constructed with the CMC wall. By way of example, the chord-wise stiffener 80 may be attached to the CMC wall 81 via a bolt 82 or similar fastener.

As illustrated in FIG. 9, a chord-wise stiffener 90 may comprise a stacking of fiber material disposed over the CMC wall 92 to increase the thickness of the airfoil wall along the chord length of the airfoil.

Figure 11:
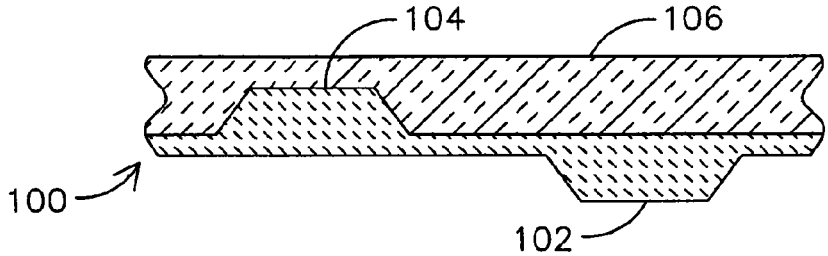
FIG. 11 illustrates an exemplary chord-wise stiffener that comprises in combination inner ribs, disposed on an inner surface of the CMC wall, and outer ribs, disposed on an outer surface of the CMC wall.

FIG. 11 illustrates a chord-wise stiffener 100 that comprises a first stiffener section 102 (e.g., an inner rib) disposed on an inner surface of the CMC wall and a second stiffener section 104 (e.g., an outer rib) disposed on an outer surface of the CMC wall. A thermal insulating layer 106 may be disposed to encapsulate stiffener section 104 as well as other portions of the outer surface of the CMC wall.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim:

1. A turbine component comprising:

a ceramic matrix composite defining a wall;

a stiffener disposed on said wall, said stiffener generally extending along a chord length of the component, wherein the stiffener is disposed on an outer surface of said wall; and a layer of insulation material joined to said stiffener.

2. The turbine component of claim 1 wherein said component is internally pressurized.

3. The turbine component of claim 1 wherein the wall defines a hollow interior for the turbine component.

4. The turbine component of claim 1 wherein said stiffener constitutes an integral structure relative to said wall.

5. The turbine component of claim 1 wherein said stiffener constitutes a separate structure relative to said wall.

6. The turbine component of claim 1 wherein said stiffener defines a cavity, said cavity filled with a fluid.

7. The turbine component of claim 1 wherein said stiffener comprises at least one rib along a periphery of the wall.

8. The turbine component of claim 1 wherein said stiffener comprises an angle relative to the chord-length, said angle based on a type of pressure load for the turbine component, said type of pressure load selected from the group consisting of an internal pressure load and an external pressure load.

9. A turbine component comprising:

a ceramic matrix composite defining a wall; and a stiffener disposed on said wall, said stiffener generally extending along a chord length of the component, wherein said stiffener defines a cavity, said cavity filled with a ceramic material.

10. A turbine component comprising:

a ceramic matrix composite defining a wall; and a stiffener disposed on said wall, said stiffener generally extending along a chord length of the component, wherein said stiffener comprises a stack of fiber material deposited on said wall.

11. A turbine component comprising:

a ceramic matrix composite defining a wall;

a stiffener disposed on said wall, said stiffener generally extending along a chord length of the component, wherein said stiffener is disposed over a predefined region of the component that comprises less than an entire chord length of the component, wherein at least a section of the stiffener is disposed on an outer surface of said wall; and a layer of insulation material joined to said section of the stiffener.

12. The turbine component of claim 11 wherein said predefined region is selected from the group consisting of a leading edge region and trailing edge region of the component.

13. A turbine component comprising:

a ceramic matrix composite defining a wall; and a stiffener disposed on said wall, said stiffener generally extending along a chord length of the component, wherein the stiffener comprises a first stiffener section disposed on an inner surface of said wall and a second stiffener section disposed on an outer surface of said wall.

14. A turbine component comprising:

a ceramic matrix composite defining a wall;

a stiffener disposed on an outer surface of said wall, said stiffener generally extending along a chord length of the component, wherein said stiffener comprises a first stiffener configuration over a predefined first region of the component, and further comprises a second stiffener configuration over a predefined second region of the component, the second and first stiffener configurations being different relative to one another; and a layer of insulation material joined to said stiffener at least over one of said first and second regions of the component.

15. A turbine vane comprising:

a ceramic matrix composite wall member comprising an inner surface defining a core region, and an outer surface defining an airfoil shape having a chord;

a stiffener attached to the wall member and generally extending in a chord-wise direction over at least a portion of a length of the chord, wherein the stiffener is disposed on said outer surface of said wall member; and a layer of insulation material joined to said stiffener.

16. The turbine vane of claim 15 further comprising a core member in said core region and joined to said stiffener.

17. The turbine vane of claim 15 wherein said stiffener constitutes an integral structure relative to said wall member.

18. The turbine vane of claim 15 wherein said stiffener constitutes a separate structure relative to said wall member.

* * * * *